US005758455A

United States Patent [19]

Hsu

[11] Patent Number: 5,758,455

[45] Date of Patent: Jun. 2, 1998

[54] HIGH PRESSURE SERVO-MECHANISM CONTROL SYSTEM FOR CIVIL OR ARCHITECTURAL STRUCTURE

[75] Inventor: Deh-Shiu Hsu, Tainan, Taiwan

[73] Assignee: National Science Council of Republic of China, Taipei, Taiwan

[21] Appl. No.: 766,710

[22] Filed: Dec. 13, 1996

[51] Int. Cl.[6] ..... E04H 9/02

[52] U.S. Cl. ..... 52/167.1; 52/167.2; 52/167.4; 188/266; 188/282; 188/312

[58] Field of Search ..... 52/167.1–167.4; 188/266, 282, 312

[56] References Cited

U.S. PATENT DOCUMENTS

| | | | |
|---|---|---|---|
| 3,977,140 | 8/1976 | Matsuoaira et al. | 52/167.4 |
| 4,581,199 | 4/1986 | Bioret et al. | 52/167.4 |
| 5,147,018 | 9/1992 | Kobori et al. | 52/167 X |
| 5,152,110 | 10/1992 | Garza-Tamez | 52/167.1 |
| 5,259,159 | 11/1993 | Kawase et al. | 52/167.1 |
| 5,347,771 | 9/1994 | Kobori et al. | 52/167.1 |
| 5,549,282 | 8/1996 | Ikeda | 188/266 X |
| 5,560,161 | 10/1996 | Lou | 52/167.2 |
| 5,595,372 | 1/1997 | Patten | 52/167.4 X |

FOREIGN PATENT DOCUMENTS

| | | | |
|---|---|---|---|
| 403257268 | 11/1991 | Japan | 52/167.1 |

*Primary Examiner*—Carl D. Friedman
*Assistant Examiner*—Yvonne Horton-Richardson
*Attorney, Agent, or Firm*—David E. Dougherty

[57] ABSTRACT

The present invention relates to a high pressure servo-mechanism to be installed in a civil or architectural structure to alleviate dynamic reaction of the protected structure and to prevent the possible damages to the structure by earthquakes or typhoons thus assuring the security of human lives and properties inside the structure.

7 Claims, 9 Drawing Sheets

TYPE III

HIGH PRESSURE SERVO-MECHANISM CONTROL SYSTEM FOR CIVIL OR ARCHITECTURAL STRUCTURE

BACKGROUND OF THE INVENTION

1. Field of the Invention

The present invention relates to a high pressure servo-mechanism with a function of dual way control which, if installed in the civil or architectural structure, is able to alleviate dynamic reaction of the structure effectively to prevent the possible disastrous damages to the structure by earthquakes or strong winds.

When suffering from abnormal attacking forces of earthquakes or strong winds, it is observed the dynamic reaction of a flexible structure is often apt to exceed its allowable limit entailing the following abominable results:

1. Uncomfortable to the residents.
2. Endangering the security of the structure.
3. Mutual collision causing damages to the flexible structures.

It is a worthwhile study concerning how to alleviate such dynamic reaction to assure the safety of a structure, accordingly, it is a feasible solution to develop a relevant control method to reduce the dynamic reaction of a structure when it is under the influence at strong abnormal forces.

2. Description of the Prior Art

The present novel invention is realized under financial support of National Science Council of Executive Yuan, R.O.C., characterized in applying a high pressure servo-mechanism to civil or architecture structure for resisting earthquakes or strong winds, the invention is clearly different in the theoretical view point from the conventional passive control system of base isolation and active control system employing a brake mechanism with cascading bonded steel strips. Know in the filed of structure design.

In the following theoretical analysis, those complicated factors affecting the performance of an oil pressure mechanism such as retarding effect caused by the viscousity of oil and others are neglected for simplifying the derivation of related formulas.

Type I Control:

The motion equation of high pressure servo-mechanism installed at the slab of jth story, if neglecting the retarding effect of oil viscousity, may be expressed by the following equation:

$$U_j(t)=-P_j(t)A_jSgn(X_j(t)-X_{j-1}(t))\times H(|X_j(t)-X_{j-1}(t)|-d) \quad (1)$$

j=2, 3, . . . n

In equation(1), $U_j$ represents the control force to the slab of jth story by said mechanism;

$P_j(t)$ represents the oil pressure input to said structure;

$A_j$ represents the cross section area of the piston in oil cylinder of said mechanism;

$$S_{gn}(\delta)=\begin{cases}+1 & \text{if } \delta>0\\ -1 & \text{if } \delta<0\end{cases}$$

H(.) is an unit step function;

d is a buffer distance which is equals to half of the difference of piston width minus the diameter of the oil pressure tube;

when oil pressure of the high pressure servo-mechanism reaches the constant value $P_j(t)=P_j$, the equation(1) can be rewritten as $$U_j(t)=-P_jA_jSgn(X_j(t)-X_{j-1}(t))\times H(|X_j(t)-X_{j-1}(t)|-d) \quad (2)$$

Equation(2) represents a mathematical control formula exclusively for the relative displacement. The above described principle belongs to Type I control.

Type II Control

If the direction of relative velocity of displacement between adjacent store's is taken into account during application of a control force, the control equation of Type II control principle can be derived as follows:

$$U_j(t)=-P_jA_jH(|A_j(t)-X_{j-1}(t)|-d)\times I \quad (3)$$

Wherein $$I=S_{gn}(Xj(t)-X_{j-1}(t))\times H(H_j(t)-X_{j-1}(t))\times(V_j(t)-V_{-1}(t)) \quad (4)$$

$V_j(t)$ represents the displacement velocity of the slab of the jth story.

In the equations(3) and (4), it is obvious that the control force stops functioning when the directions of relative velocity of movement and relative displacement between adjacent stores are opposed.

Type HI Control

Further to the above description, if a control force is applied in the same direction with the relative displacement between the adjacent stories in the case that the direction of relative velocity of movement is in opposite to that of the relative displacement between the adjacent stories, the equation for Type III Control may be derived as $$U_j(t)=-P_jA_jH(|X_j(t)-X_{j-1}(t)|-d)\times I_1\times I_2 \quad (5)$$

Wherein $$I_1=S_{gn}[X_j(t)-X_{j-1}(t)]\times[V_j(t)-V_{j-1}(t)]$$

$$I_2=S_{gn}[X_j(t)-_{Xj-1}(t)]$$

FIGS. 4 and 5 show a result by applying the above described three types of control principle to a single story building with rigid framework.

Owing to the fact that satisfactory results can not be obtained from the computation according to the equations of types 1, 2 and 3 enumerated above as shown on those curves plotted on FIGS. 4 and 5, for the purpose of discarding the oil and releasing the oil pressure rapidly the high pressure servo-mechanism has been made a relevant reformation and afterward put on a vibration platform for a practical model test. Since the test involved all influential factors as retarding effect caused by oil viscousity etc., the test results obtained are much more satisfactory than those obtained from pure theoretical computation. The typical test results are shown on FIGS. 6 and 7.

SUMMARY OF THE INVENTION

The present invention relates to a high pressure servo-mechanism installed in the civil or architectural structure which is able to alleviate dynamic reaction of the structure (relative displacement between the adjacent storys of high rise building) effectively to prevent possible disastrous damages to the structure by earthquakes or strong winds.

The advantageous features of the present invention are:

1. A simple mechanical device without employing sophisticated electronic components.
2. Only a district power source is sufficient without connecting to a city central power systems. When the central power systems break down during the attack of strong earthquake, said mechanism is still able to work normally.

BRIEF DESCRIPTION OF THE DRAWINGS

The invention, as well as its many advantages, may be further understood by the following detailed description and drawings in which.

Symbols illustration.

| | | | | | |
|---|---|---|---|---|---|
| 1 | upper oil cylinder | 2 | lower oil cylinder | 31 | upper shaft |
| 32 | lower shaft | 41 | upper piston | 42 | lower piston |
| 5 | Pressure input hole | 6 | upper pressure relief hole | 10 | column |
| 7 | oil pressure relief tube | 71 | liquid flowing hole | 13 | spring |
| 8 | lower pressure relief hole | 9 | slab | | |
| 11 | steel cable | 12 | compressed oil tank | | |
| 14 | wheel | 15 | oil cylinder fixing framework | | |

DETAILED DESCRIPTION OF THE PREFERRED EMBODIMENT

Figure 1:
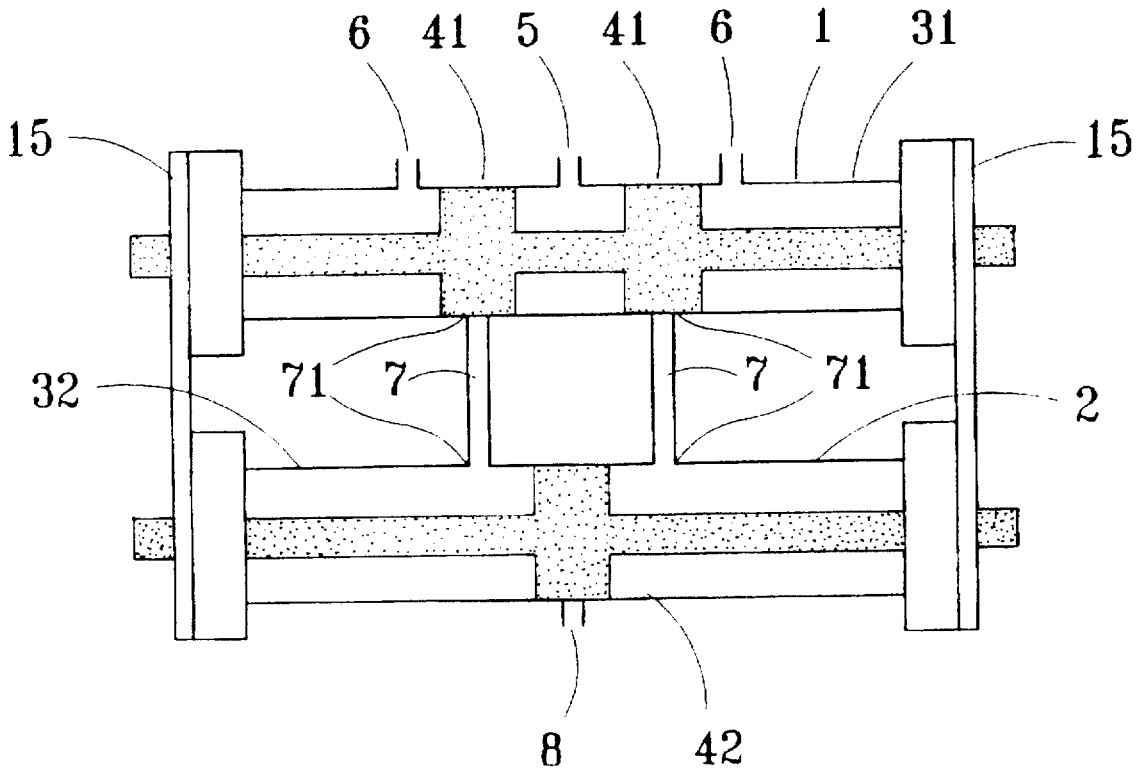
FIG. 1 is a cross section view for the first preferred embodiment of the present invention.

Referring to FIG. 1, the mechanism according to the invention comprises an upper oil cylinder 1 and a lower oil cylinder 2 as its basic components, individual oil hole is provided with each cylinder for compressed oil to flow in and out, an oil pressure relief tube 7 is installed between the two oil cylinders for assuring normal function of said mechanism. The upper oil cylinder 1 comprise an upper shaft 31, and two upper pistons 41 attached to the upper shaft 31. The shape and dimension of the cross section of upper position 41 is identical to that of the inner cross section of the upper oil cylinder 1. The upper piston 41 shall be able to move freely in the upper oil cylinder 1. Two upper pressure relief holes 6 are provided on the upper wall of the oil cylinder 1 positioned at the chamber outward said pistons 41. Two liquid flow holes 71 are provided on the lower wall of the upper cylinder 1 under the two upper pistons 41, the diameter of width of said hole shall not be larger than width of the upper piston 41 and said hole shall be adapted to the oil pressure relief tube 7. A pressure input hole 5 is opened on the upper oil cylinder 1 between two pistons 41 for supplying pressure from outside. This pressure shall be retained continuously without interruption between the two pistons 41. Should the upper pistons and oil cylinder fail to adjoin and seal closely resulting in leakage of oil into the fissure between the pistons and the cylinder, some oil releasing means is necessary to prevent the oil pressure producing in the fissure. A lower shaft 32 is installed in the lower oil cylinder 2, and a lower piston 42 is attached to it, the shape and dimension of the cross section of lower piston 42 is identical to that of the inner cross section of the lower oil cylinder 2. The lower piston 42 shall be able to move freely in lower oil cylinder 2. Two liquid flow holes 71 shall be bored on the lower oil cylinder wall at the appropriate positions with respect to both sides of the lower piston 42 for adapting the oil pressure relief tube 7. Both ends of the lower oil cylinder are fixed to that of the upper oil cylinder 1. A lower pressure hole 8 is opened on the lower oil cylinder wall under the lower piston 42, wherein the diameter of width of said hole should not be larger than the width of the lower piston 42.

Figure 2:
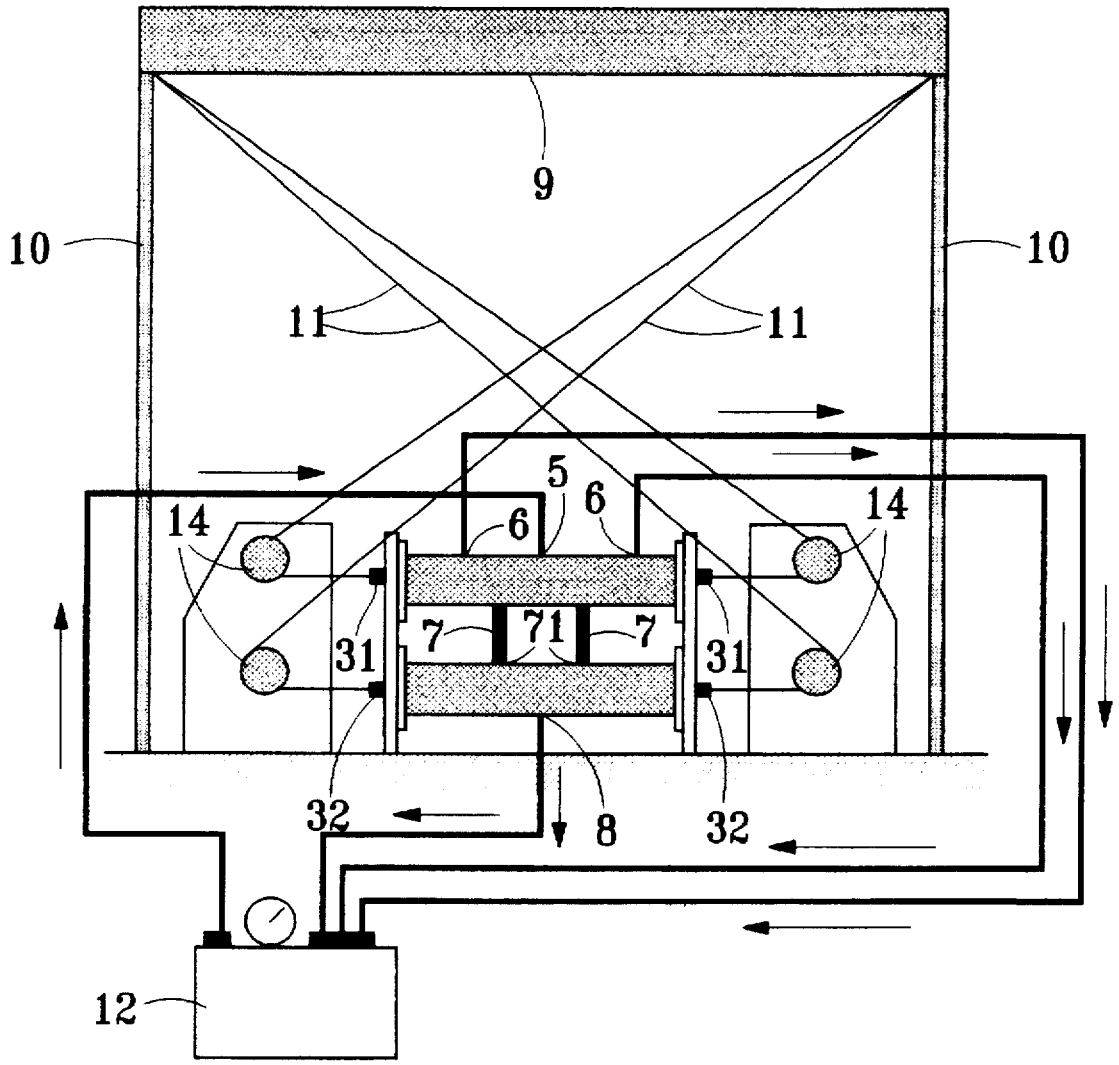
FIG. 2 is a drawing showing the test procedures for the first preferred embodiment of the present invention.

Referring to FIG. 2, it is observed that four steel cables are installed on both sides of upper and lower shafts 31,32 of the upper and lower oil cylinders 1, 2 and further, said cables are connected to the slab 9 via four wheels 14. If shall 9 moves to the left at the moment the structure is suffering the attack of external force, the steel cables 11 will pull the upper shaft 31 of upper oil cylinder 1 to the right.

Figure 3:
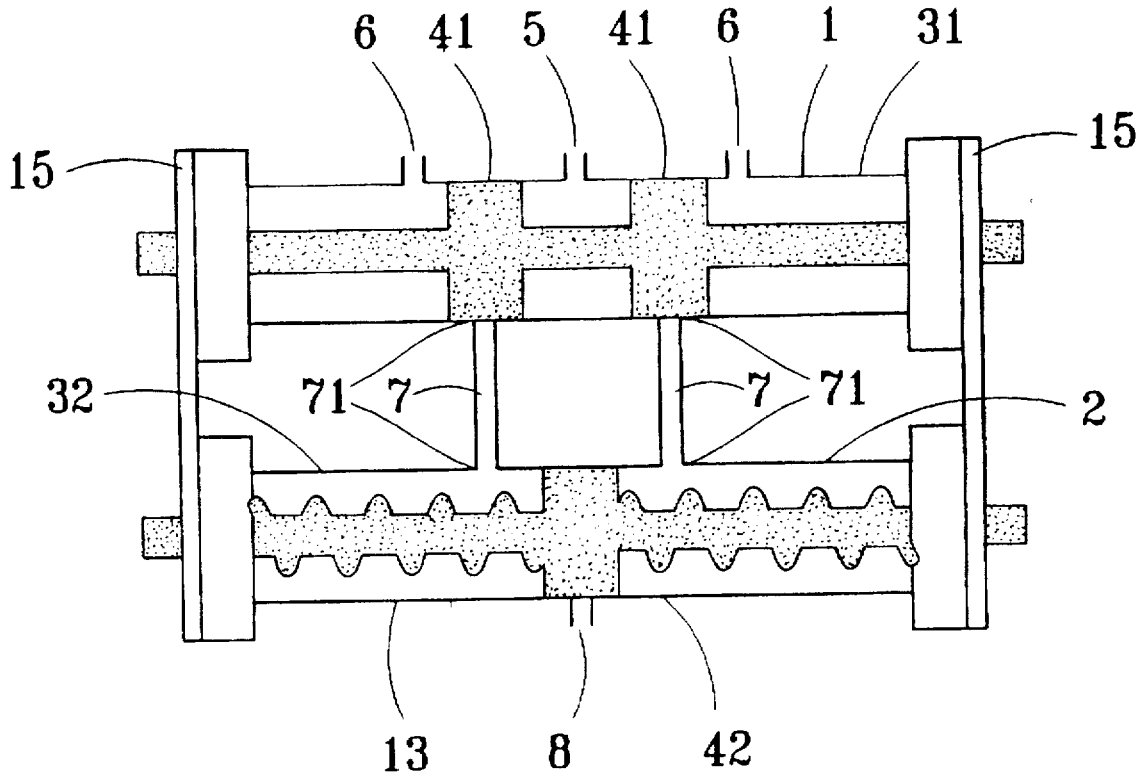
FIG. 3 is a cross section view for the second preferred embodiment of the present invention.
Figure 4:
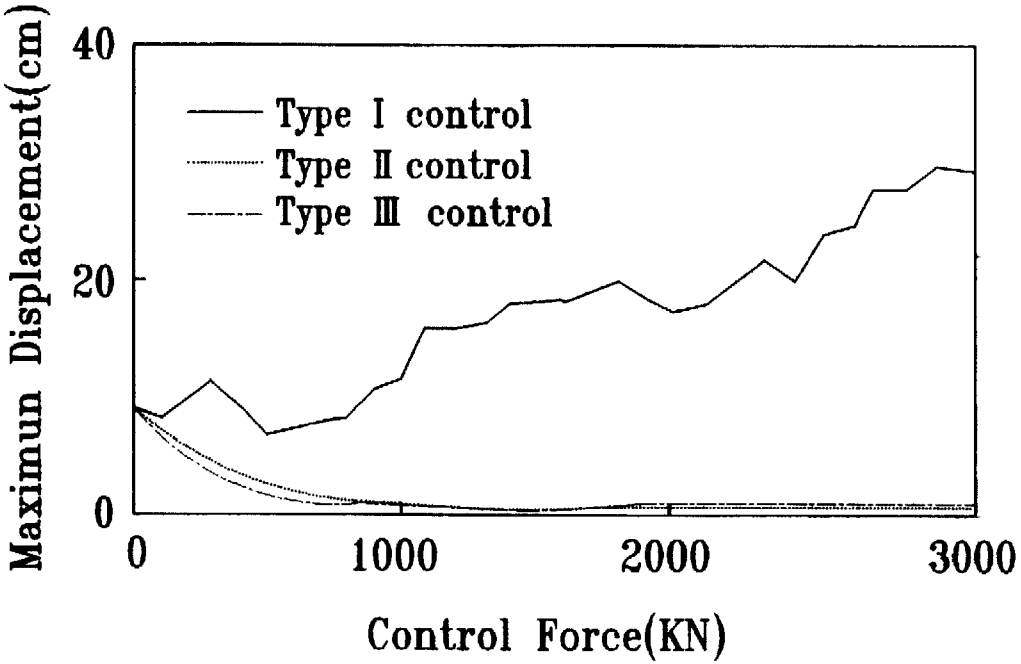
FIG. 4 shows curve plotted according to the theoretical analysis with each type of control principle for comparison.
Figure 5A:
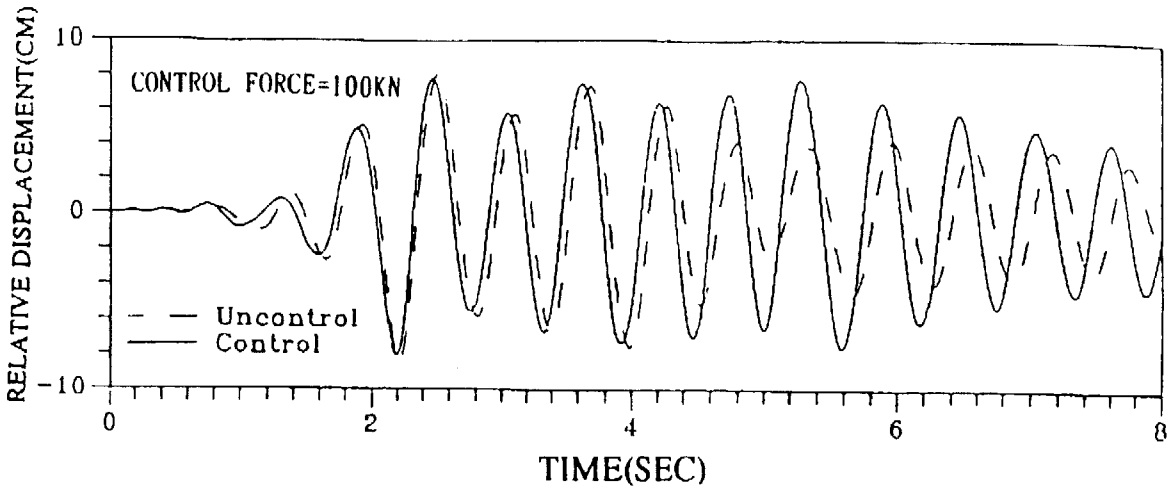
FIG. 5 are curves showing control effects obtained from the theoretical analysis with each type of control principle plotted in time (second) VS displacement (cm)
Figure 5B:
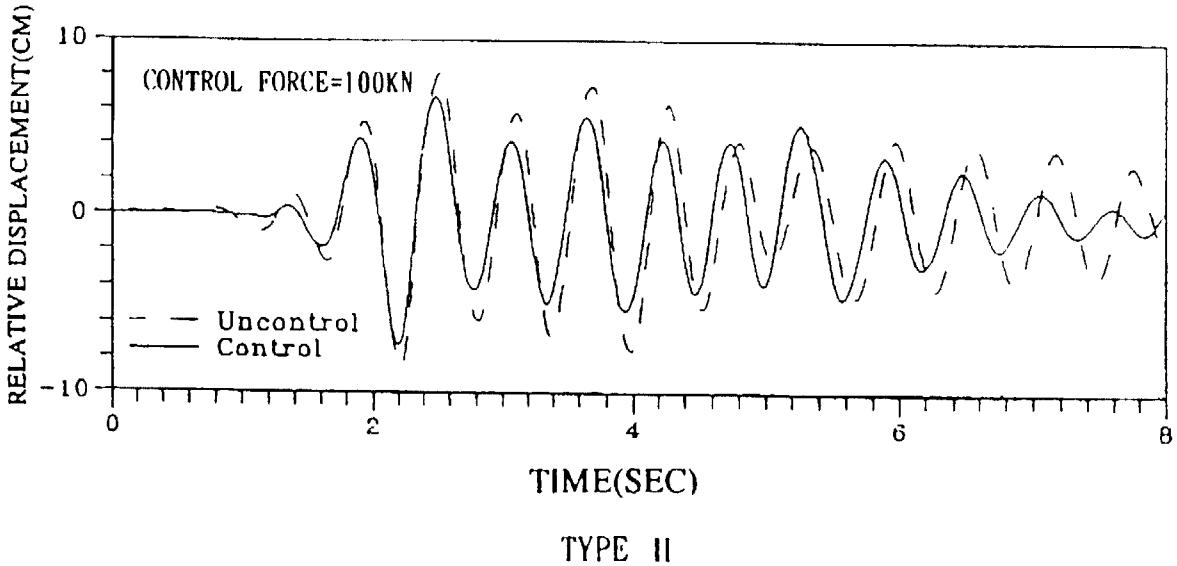
Figure 5C:
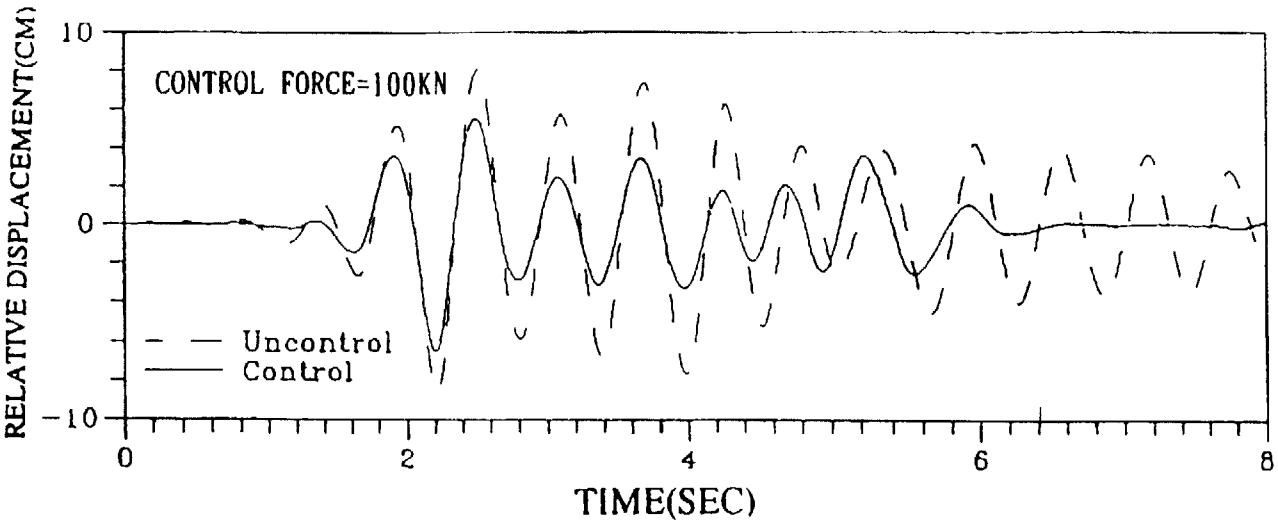
Figure 6:
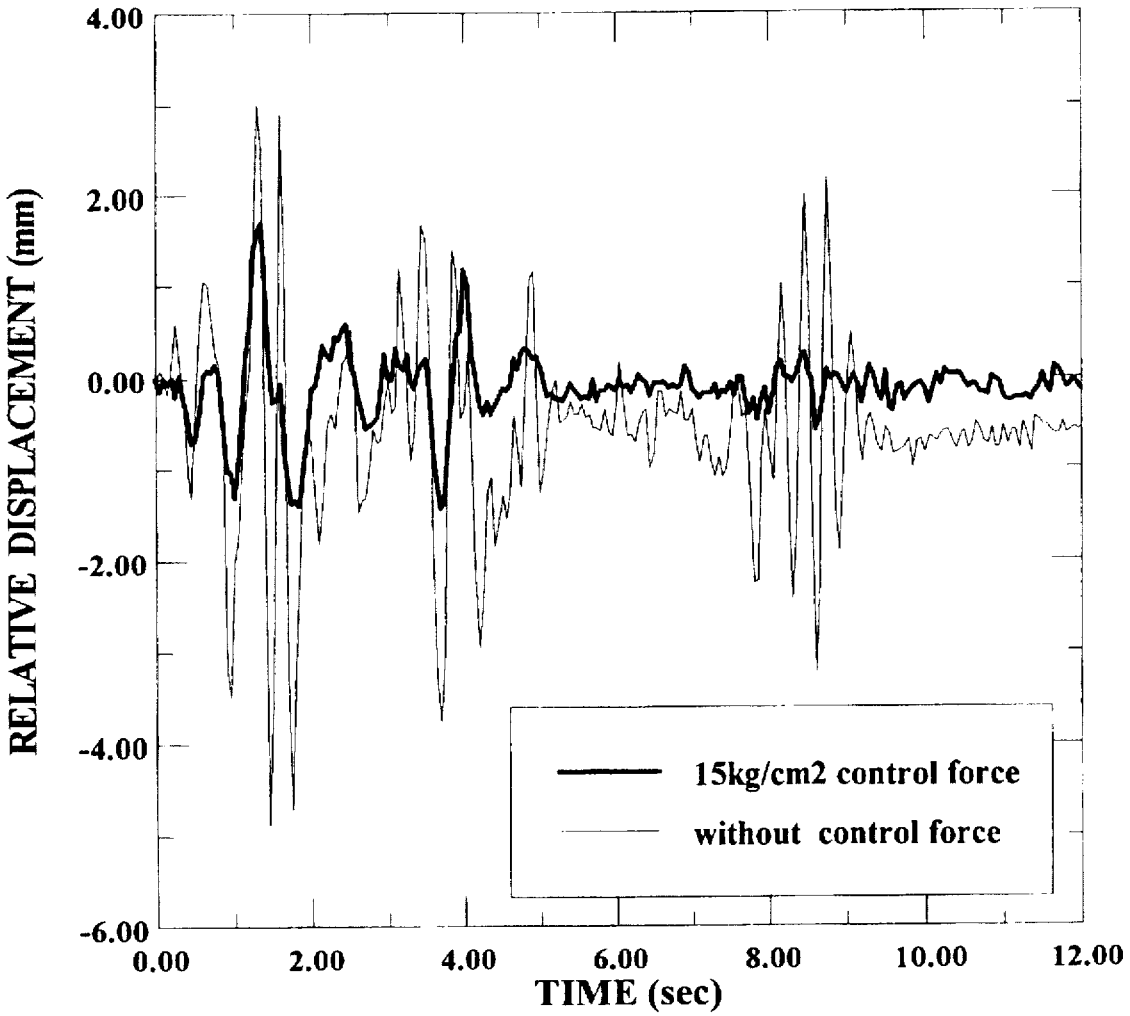
FIG. 6 are curves showing test results with each type of control principle plotted in time (second )VS displacement (mm)
Figure 7A:
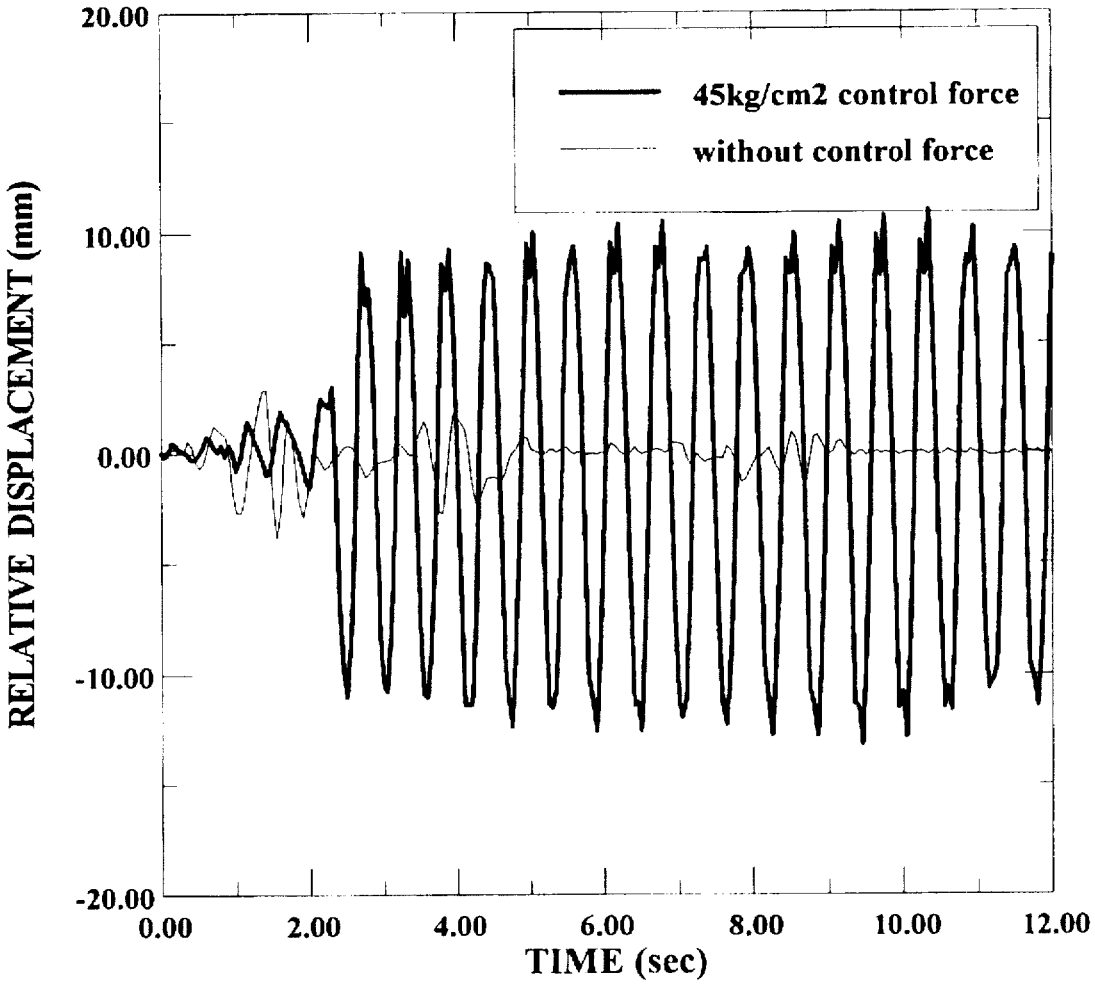
FIG. 7A are curves showing test results plotted in time (second) VS displacement(mm) before the reformation of the mechanism.
Figure 7B:
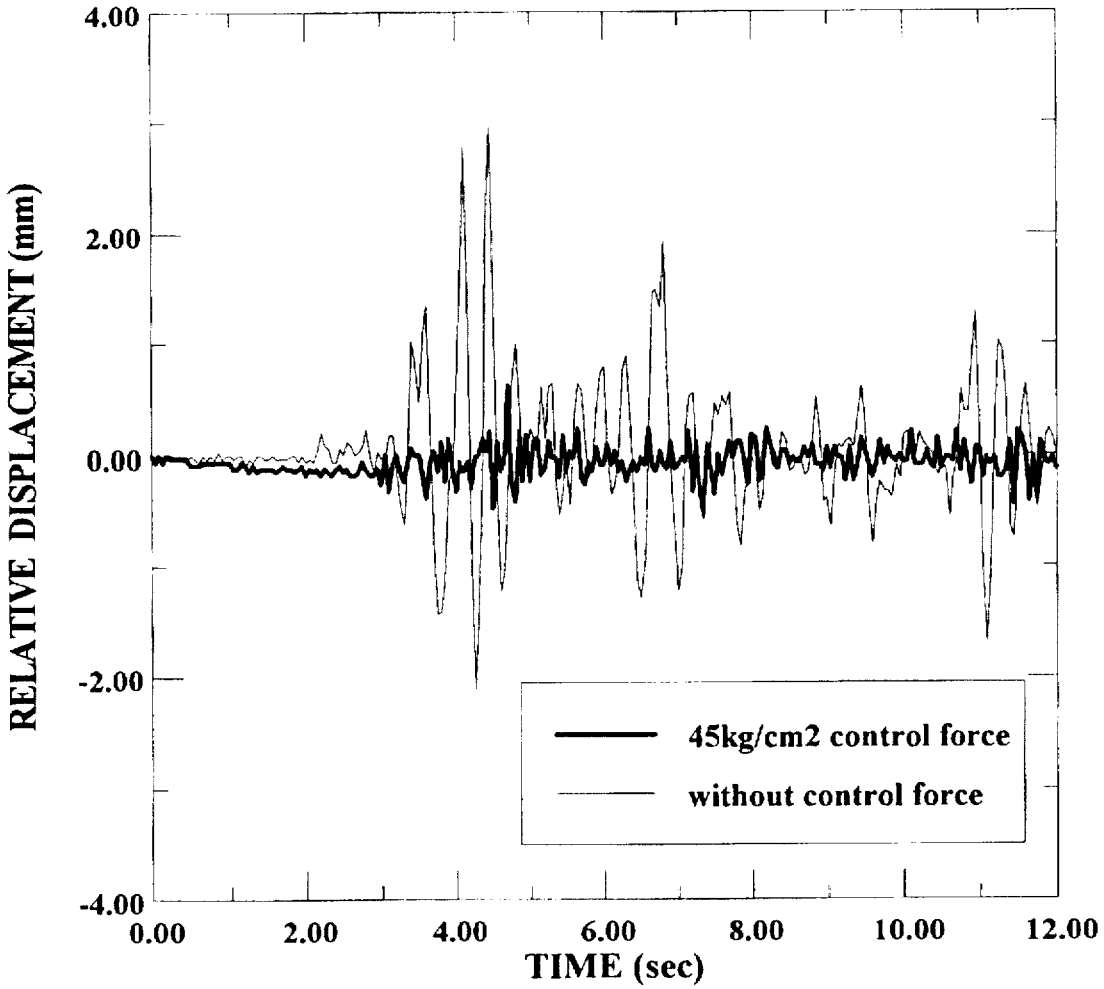
FIG. 7B are curves showing test results plotted in tine (second) VS displacement (mm) after the reformation of the mechanism; and Appendix 1 is photograph of the mechanism under model test according to invention (has not been open to public).

In case the displacement distance is so large that the upper piston 41 at the right is unable to cover the oil pressure relief tube 7, the compressed oil existing between the two pistons then flows via oil pressure relief tube 7 at the right side into the right side of lower piston 42 of the lower oil cylinder 2. Meanwhile the right side space of lower piston 42 is filled with oil, the oil pressure produced will drive the piston 42 to the left and so follows the shaft 32 to furnish a control force via steel cables 11 connected to said shaft 32 for pulling slab 9 back to the right. In case the displacement of the piston 42 is too large that it is unable to cover the under pressure relief hole 8, oil pressure may be rapidly relieved through the pressure relief hole 8, or by way of the oil pressure relief tube 7 and then through the upper pressure relief hole 6 of upper oil cylinder 1 as well, accordingly the shaft 31 returns to its initial position since the slab 9 has been drawn back to right. The continuous movement of shaft 32 to the left will be halted by relieving oil pressure rapidly through the hole 8 so that the excessive right hand displacement of the roof is prevented. On the other hand, for the purpose of enhancing the strength of structure, a spring 13 (as shown on FIG. 3) may be added to the lower oil cylinder 2 for increasing the buffer effect of said mechanism to shock.

The basic principle of the present invention is illustrated hitherto in the single direction, however, under the influence of actual applied dynamic force, the structure will swing horizontally, the mechanism according to the invention may offer the protected structure a relevant control force in the direction both to the right and to the left at the instance of swinging to alleviate the dynamic reaction of the structure. The oil pressure required for the mechanism is furnished from a compressed oil tank 12 with pre-set value of pressure. In general, higher the oil pressure, the control effect of the mechanism according to the invention will be greater too, in other words, higher the oil pressure, lesser the dynamic reaction of the structure.

The theoretical derivation and the actual experiment has testified the effectiveness of the mechanism of the present invention for reducing the dynamic reaction of the structure to shock and thus preventing the damages to the structure. (For the detailed description, please refer to Research Report NSC 85-2621-P006-027 issued by National Science Council, The Executive Yuan, R.O.C.)

Many changes and Modifications in the above described embodiment of the invention can, of course, be carried out without departing from the scope thereof Accordingly, to promote the progress in Science and the useful arts, the invention is disclosed and is intended to be limited only by the scope of the appended claims.

What is claimed is:

1. A high pressure servo-mechanism control system for civil or architectural structure comprise;

an upper oil cylinder with a shaft and two pistons in it, a pressure input hole, two liquid flow holes and two pressure relief holes being provided on said cylinder;

a lower oil cylinder with a shaft and a piston in it, two liquid flow holes being provided on the position wall;

two oil pressure relief tubes interconnecting the liquid flow holes of the upper and lower oil cylinder in order for keeping normal function of said mechanism system;

four steel cables transmitting the external dynamic forces exerted on the roof to the shafts in the oil cylinders through to four wheels;

four wheels installed between the steel cables and the shafts of the oil cylinders for turning the direction of dynamic external forces and control force; and a compressed oil tank to furnish pressure of pre-set value; by applying said mechanism control system to the structure, the dynamic reaction of the protected structure to the external shock force can be reduced with the effects of shock-resist and wind-proof.

2. A high pressure servo-mechanism control system for civil or architectural structure as claimed in claim 1, wherein the medium for producing require pressure may be various kinds of liquid oils, gases or other materials being able to produce a required pressure.

3. A high pressure servo-mechanism control system for civil or architectural structure as claimed in claim 1, wherein the shape and dimension of the oil cylinders, shape and dimension of the shafts in said cylinders, number of the pistons and their shape and dimension, number of the holes and their shape and dimension, number of the oil pressure relief tubes, steel cables and wheels and their shape and dimension are all changeable according to actual requirements.

4. A high pressure servo-mechanism control system for civil or architectural structure as claimed in claim 1, wherein a spring may be added to the oil cylinder for increasing the buffer effect of said mechanism to shock, yet still able to enhance the stiffness of the structure to dynamic reaction.

5. A high pressure servo-mechanism control system for civil or architectural structure as claimed in claim 1, wherein the various ways can be applied for steel cables to transmit the control force, and the steel cables may be replaced by other appropriate equivalent materials.

6. A high pressure servo-mechanism control system for civil or architectural structure as claimed in claim 1, wherein said mechanism can be applied to the same structure together with other kinds of similar shock resisting devices in parallel or cascade connection to attain the effect of reducing the dynamic reaction of the structure to external forces.

7. A high pressure servo-mechanism control system for civil or architectural structure as claimed in claim 1, wherein various designs for the type of the compressed oil tank which furnishes the required oil pressure for the mechanism are allowable.

* * * * *